US012514356B2

(12) United States Patent
Subinya et al.

(10) Patent No.: US 12,514,356 B2
(45) Date of Patent: Jan. 6, 2026

(54) PERFUME-CONTAINING SHAPED BODY

(71) Applicant: Henkel AG & Co. KGaA, Duesseldorf (DE)

(72) Inventors: Mireia Subinya, Massenbachhausen (DE); Peter Schmiedel, Duesseldorf (DE); Regina Stehr, Neuss (DE); Ines Baranski, Cologne (DE); Rolf Herrmann, Duisburg (DE); Christina Mertens, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 695 days.

(21) Appl. No.: 17/583,025

(22) Filed: Jan. 24, 2022

(65) Prior Publication Data

US 2022/0142332 A1 May 12, 2022

Related U.S. Application Data

(63) Continuation of application No. PCT/EP2020/064992, filed on May 29, 2020.

(30) Foreign Application Priority Data

Jul. 23, 2019 (DE) ..... 102019210894.6

(51) Int. Cl.
*A45D 37/00* (2006.01)
*A45D 34/04* (2006.01)
*D06M 13/00* (2006.01)

(52) U.S. Cl.
CPC ..... *A45D 37/00* (2013.01); *A45D 34/04* (2013.01); *D06M 13/005* (2013.01); *A45D 2200/1018* (2013.01)

(58) Field of Classification Search
CPC ..... A45D 37/00; A45D 34/04; A45D 2200/1018; D06M 13/005
See application file for complete search history.

(56) References Cited

U.S. PATENT DOCUMENTS

| | | | | |
|---|---|---|---|---|
| 2008/0131695 | A1 | 6/2008 | Aouad et al. | |
| 2018/0334642 | A1* | 11/2018 | Hodgdon | A61Q 5/12 |
| 2020/0325421 | A1* | 10/2020 | Segler | C11D 3/2093 |

FOREIGN PATENT DOCUMENTS

| | | | |
|---|---|---|---|
| DE | 69016695 | T2 | 7/1995 |
| DE | 10360842 | * | 12/2004 |
| WO | WO 02/044310 | * | 6/2002 |
| WO | 2017004339 | A1 | 1/2017 |
| WO | 2018213170 | A1 | 11/2018 |

OTHER PUBLICATIONS

German Search Report DE 10 2019 210 894.6 Completion Date: Mar. 3, 2020; Mail Date: Mar. 3, 2020 6 Pages.
PCT International Search Report PCT/EP2020/064992 Completion Date: Oct. 2, 2020; Mail Date: Nov. 3, 2020 3 Pages.

* cited by examiner

*Primary Examiner* — Shirley V Gembeh
(74) *Attorney, Agent, or Firm* — Bojuan Deng

(57) ABSTRACT

A shaped body having a) carrier material, and b) fragrance, wherein the shaped body has a mass between 3 and 25 g and the ratio of body surface area to body volume is 2 $cm^{-1}$ to 10 $cm^{-1}$. The invention also relates to the use thereof and to a method for using the shaped bodies.

20 Claims, No Drawings

PERFUME-CONTAINING SHAPED BODY

FIELD OF THE INVENTION

The present invention relates to a perfume-containing shaped body. The invention also relates to methods for producing the shaped body, as well as to a textile detergent which contains the shaped body. In addition, the present invention also relates to the use of the perfume-containing shaped body or of such a textile detergent for cleaning or caring for textiles.

BACKGROUND OF THE INVENTION

When using detergents and cleaning agents, the consumer not only aims to wash, clean or care for the objects to be treated, but also wishes that after treatment, for example after washing, the treated objects, such as textiles, have a pleasant smell. For this reason in particular, most commercially available detergents and cleaning agents contain fragrances.

Fragrances are often used in the form of fragrance particles, either as an integral constituent of a detergent or cleaning agent, or dosed into the washing drum right at the beginning of a wash cycle in a separate form. In this way, the consumer can control, by means of individual metering, the fragrancing of the laundry to be washed.

The main constituent of such fragrance pastilles known in the prior art is, for example, a water-soluble or at least water-dispersible carrier polymer, such as polyethylene glycol (PEG), which is used as a vehicle for the integrated fragrances and which dissolves more or less completely in the washing liquor during the washing process, so as to release the fragrances contained and optionally other components into the wash liquor. For the preparation of the known fragrance pastilles, a melt is produced from the carrier polymer, which melt contains the remaining ingredients, or these are then added, and the resulting melt is then fed to a shaping process, during the course of which the melt cools, solidifies and assumes the desired shape.

The disadvantage of known fragrance pastilles is the loss of volatile fragrances which escape from the pastille into the surrounding atmosphere. While this continuous release of fragrances is desirable insofar as it gives the consumer an (olfactory) impression of the fragrance particle, it leads to a measurable loss of performance of the fragrance pastilles in the event of prolonged storage or storage in open containers.

Another disadvantage of known fragrance pastilles, which also has an effect on their product performance and compliance with the product promise to the consumer, is the oxidation sensitivity of individual fragrances, which are oxidatively destroyed when exposed to atmospheric oxygen. Even the oxidative destruction of the smallest amount of constituents of the perfume contained in the fragrance pastille can cause a perceptible change in the olfactory impression.

In addition to the aforementioned disadvantages, the fragrance pastilles available on the market to date tend to clump together when stored for a long period of time, which in turn impairs the disability and dosing accuracy of the fragrance pastilles.

Finally, there is a continuous need for aesthetically pleasing product shapes.

BRIEF SUMMARY OF THE INVENTION

Against the technical background outlined above, the technical object was to provide compositions which are distinguished by a long-lasting, high-quality fragrance effect, can be dosed in a reliable manner and also have an attractive appearance.

In a first aspect, the present patent application is directed to a shaped body comprising (a) carrier material, and (b) fragrance, the shaped body having a mass between 3 and 25 g and the ratio of body surface area to body volume being 2 $cm^{-1}$ to 10 $cm^{-1}$.

A shaped body should be understood to mean a body produced by means of a shaping method. Preferred shaped bodies are dimensionally stable. Bodies are considered dimensionally stable if they have an inherent dimensional stability that enables them to assume a non-disintegrating three-dimensional shape under the usual conditions of manufacture, storage, transport and handling by the consumer, this three-dimensional shape also not changing under the conditions mentioned over an extended period of time, preferably 4 weeks, particularly preferably 8 weeks and in particular 32 weeks, i.e., under the usual conditions of manufacture, storage, transport and handling by the consumer, the body remains in the three-dimensional geometric shape created during manufacture, i.e., it does not dissolve.

The mass of preferred shaped bodies is 4 to 22 g and in particular from 5 to 20 g. Corresponding shaped body masses ensure a balanced ratio of carrier material and fragrance with a sufficient fragrance effect and in this way simplify the production of the shaped body.

It has proven particularly advantageous for the technical effect if the shaped bodies have a ratio of body surface area to body volume of 2.5 $cm^{-1}$ to 8 $cm^{-1}$ and in particular of 3 $cm^{-1}$ to 7 $cm^{-1}$. Such shaped bodies are distinguished by a uniform and lasting fragrance profile with good dissolution properties.

The shaped body can be designed in different ways, provided that the characteristic ratio of body surface area to body volume is maintained.

The production of the shaped bodies is simplified if they have at least one planar face or outer surface. The shaped bodies preferably have neither a hemispherical nor a spherical three-dimensional shape.

An example of a shaped body has a planar contact surface and a convex polyhedral dome surface adjoining the contact surface. However, the shaped bodies preferably neither have a cubic three-dimensional shape nor are they in the form of other convex bodies.

The shaped bodies preferably have at least one convex or one concave face. However, shaped bodies are particularly preferred which have at least one face that comprises convex and concave portions.

Examples of shaped bodies are based on geometric patterns or objects from nature or technology.

The procedural handling including the packaging of the shaped bodies is facilitated if the shaped body has at least one mirror plane.

The surface of the cleaning-agent shaped body can have imprints. These imprints can also be geometric patterns, pictorial forms, warning notices, letters, names, numbers or brand names. For better identification, the imprints and the surrounding contact surface can have different colors. For example, the imprints can be colored.

Preferred shaped bodies have a spatial extent of more than 12 mm, preferably more than 18 mm, particularly preferably more than 24 mm and in particular more than 30 mm, in at least one spatial direction.

In addition to the ratio of body surface area to body volume, the fragrance profile of the shaped bodies can also be influenced by the shaped body density. Since the shaped bodies are generally used in aqueous media, where they disintegrate or dissolve and develop their fragrance profile, the density of this aqueous medium is the relevant reference point for characterizing the shaped bodies.

Shaped bodies having a density above 1 $g/cm^{-3}$, preferably in the range between 1.05 and 1.5 $g/cm^{-3}$, particularly preferably in the range between 1.05 and 1.2 $g/cm^{-3}$, are distinguished by accelerated decomposition or dissolution behavior and accelerated fragrance release.

In contrast, it is possible to delay the fragrance release by lowering the density to values below 1 $g/cm^{-3}$, preferably in the range between 0.5 and 0.95 $g/cm^{-3}$, particularly preferably in the range between 0.7 and 0.9 $g/cm^{-3}$.

Influencing the odor release kinetics of the shaped bodies in an aqueous liquor in turn makes it possible, for example, to vary the intensity and/or duration of the fragrancing of textile fabrics which are present in the aqueous liquor.

The shaped bodies can be configured as single-phase or multiphase shaped bodies. A "phase" is a visually perceptible, coherent spatial region of the shaped body that preferably constitutes at least 5 vol. %, preferably 10 to 90 vol. % and in particular 20 to 80 vol. %, of the shaped body. A two-phase shaped body therefore comprises two visually distinguishable, coherent spatial regions, one region of which covers, for example, 10 vol. % of the shaped body, and the other region of which covers, for example, 90 vol. % thereof.

Particularly preferred shaped bodies have two phases. The two-phase nature expands the number of aesthetic options in the design of the shaped bodies and also allows the separation of incompatible or different active substances. For example, it is possible to load the different phases of the shaped bodies with different fragrances.

Preferred shaped bodies comprise a water-soluble carrier material. The proportion by weight of the carrier material, preferably the water-soluble carrier material, with respect to the total weight of the shaped body, is preferably 20 to 95 wt. %, preferably from 40 to 90 wt. % and in particular from 45 to 90 wt. %.

The shaped bodies can be produced using different methods. Examples of processes are compaction/tableting or extrusion. The production of melt shaped bodies or gel shaped bodies is preferred.

In a preferred embodiment, the shaped bodies are melt shaped bodies. The two particularly preferred carrier materials for melt shaped bodies are polyethylene glycol and sodium acetate.

In a first group of preferred shaped bodies, the carrier material is selected from the group of water-soluble polymers, preferably from the group of polyalkylene glycols, in particular from the group of polyethylene glycols.

Particularly suitable are polyalkylene glycols which have an average molecular weight ($M_n$) of >1,000 g/mol, in particular >1,500 g/mol, preferably an average molecular weight between 3,000 and 15,000, more preferably an average molecular weight between 4,000 and 13,000, even more preferably an average molecular weight between 4,000 and 6,000, 6,000 and 8,000 or 9,000 and 12,000 and particularly preferably of approximately 4,000 or approximately 6,000 g/mol.

The "average molecular weight of polyalkylene glycols" is the number-average molecular weight ($M_n$), which is calculated from the OH number measured in accordance with DIN 53240-1:2012-07.

Due to their processability, storability and transportability and their technical effect, polyalkyl glycols which have a melting point between 40° C. and 90° C., in particular in the range of 45 to 70° C., are preferred. Examples of polyalkylene glycols that are suitable in the context of the present invention are polypropylene glycol and polyethylene glycol. The carrier material is very particularly preferably polyethylene glycol.

In some embodiments, the carrier material is a polyethylene glycol having an average molecular weight ($M_n$) of >1,500 g/mol, preferably an average molecular weight between 3,000 and 15,000, more preferably having an average molecular weight between 4,000 and 13,000, even more preferably having an average molecular weight between 4,000 and 6,000, 6,000 and 8,000 or 9,000 and 12,000 and particularly preferably of approximately 4,000 or approximately 6,000 g/mol. In some embodiments, a polyethylene glycol of this kind is characterized by a melting point in the range of 45 to 70° C., preferably 50 to 65° C., more preferably 50 to 60° C. "Approximately" or "about," as used herein in relation to numerical values, refers to the numerical value ±10%, preferably ±5%. A molecular weight of approximately 6,000 g/mol thus means 5,400-6,600 g/mol, preferably 5,700-6,300 g/mol.

As an alternative to the polymeric carrier materials described above, specific salts can also be used as carrier materials. These specific salts are in particular water-containing salts of which the water vapor partial pressure, at a particular temperature in the range of 30 to 100° C., corresponds to the $H_2O$ partial pressure of the saturated solution of this salt.

The melt body as described herein is produced from a solution of the carrier material in the water/water of crystallization contained in the composition; for such a solution the term "melt" is also used herein, in contrast to the established use, to refer to the state in which the carrier material dissolves by eliminating water in its own water of crystallization and thus forms a liquid. The term "melt" as used herein therefore refers to the liquid state of the composition which results when the temperature at which the carrier material eliminates water of crystallization and then dissolves in the water contained in the composition is exceeded. The invention therefore also relates to the corresponding dispersion containing the herein described (solid) substances dispersed in the melt of the carrier material. Thus, when reference is made below to the solid, particulate composition, the corresponding melt/melt dispersion from which it is obtainable is always included. Since these do not differ in composition except for the state of matter, the terms are used interchangeably herein.

A preferred carrier material is characterized in that it is selected from hydrous salts of which the water vapor partial pressure, at a temperature in the range of 30 to 100° C., corresponds to the $H_2O$ partial pressure of the saturated solution of this salt at the same temperature. As a result, the corresponding hydrous salt, also referred to herein as a "hydrate," dissolves upon reaching or exceeding this temperature in its own water of crystallization, thereby transitioning from a solid to a liquid state of matter. Preferably, the carrier materials according to the invention exhibit this behavior at a temperature in the range of 40 to 90° C., particularly preferably between 50 and 85° C., even more preferably between 55 and 80° C.

In particular, sodium acetate trihydrate ($Na(CH_3COO).3H_2O$), Glauber's salt ($Na_2SO_4.10H_2O$) and trisodium phosphate dodecahydrate ($Na_3PO_4.12H_2O$) are included in the previously described water-soluble carrier materials from the group of hydrous salts.

A particularly suitable hydrate is sodium acetate trihydrate ($Na(CH_3COO).3H_2O$), since it dissolves in the particularly preferred temperature range of 55 to 80° C., specifically at approximately 58° C., in its own water of crystallization. The sodium acetate trihydrate can be used directly as such, but it is alternatively also possible to use anhydrous sodium acetate in combination with free water, the trihydrate then forming in situ. In such embodiments, the water is used in a substoichiometric or hyperstoichiometric amount, based on the amount required to convert all the sodium acetate to sodium acetate trihydrate, preferably in an amount of at least 60 wt. %, preferably at least 70 wt. %, more preferably at least 80 wt. %, most preferably 90 wt. %, 100 wt. % or more, of the amount theoretically required to convert all of the sodium acetate to sodium acetate trihydrate ($Na(CH_3COO).3H_2O$). The hyperstoichiometric use of water is particularly preferred. With respect to the compositions according to the invention, this means that when (anhydrous) sodium acetate is used alone or in combination with a hydrate thereof, preferably the trihydrate, water is also used, the amount of water being at least equal to the amount that would be stoichiometrically required to ensure that at least 60 wt. % of the total amount of sodium acetate and its hydrates, preferably at least 70 wt. %, more preferably at least 80 wt. %, even more preferably at least 90 wt. %, most preferably at least 100 wt. %, is present in the form of sodium acetate trihydrate. As already described above, it is particularly preferable for the amount of water to exceed the amount that would be theoretically required to convert all of the sodium acetate to the corresponding trihydrate. This means, for example, that a composition containing 50 wt. % anhydrous sodium acetate and no hydrate thereof contains at least 19.8 wt. % water (60% of 33 wt. %, which would be theoretically required to convert all of the sodium acetate to the trihydrate).

DETAILED DESCRIPTION OF THE INVENTION

All of the embodiments described below can be explicitly combined with both of the aforementioned alternatives.

The carrier material of the melt shaped bodies is preferably selected from the group of hydrous salts of which the water vapor partial pressure, at a temperature in the range of 40 to 90° C., preferably of 50 to 85° C., more preferably of 55 to 80° C., corresponds to the $H_2O$ partial pressure of the saturated solution of this salt, and is more preferably sodium acetate trihydrate ($Na(CH_3COO).3H_2O$).

Particularly preferred shaped bodies comprise sodium acetate trihydrate as the carrier material in an amount of 20 to 95 wt. %, preferably of 30 to 95 wt. %, preferably of 40 to 90 wt. % and in particular of 45 to 90 wt. %, based on the total weight of the shaped body.

In an alternative preferred embodiment to that of the melt shaped bodies, the shaped body is a gel shaped body.

The hydrocolloids form a first group of preferred gelling agents. "Hydrocolloids" ("hydrophilic colloids") are macromolecules that have a largely linear shape and have intermolecular interaction forces that provide for secondary and main valence bonds between the individual molecules and thus provide for the formation of a net-like structure. They are partially water-soluble, natural or synthetic polymers that form gels or viscous solutions in aqueous systems. They increase the viscosity of the water by either binding water molecules (hydration) or absorbing and enveloping the water in their interconnected macromolecules, while at the same time restricting the mobility of the water.

The synthetic and natural hydrocolloids that are suitable according to the invention include, for example,

- organic, fully synthetic compounds, such as polyacrylic and polymethacrylic compounds, vinyl polymers, polycarboxylic acids, polyethers, polyimines and polyamides,
- organic, natural compounds, such as agar-agar, carrageenan, tragacanth, gum arabic, alginates, pectins, polyoses, guar flour, locust bean gum, starch, dextrins, gelatin and/or casein,
- organic, modified natural substances, such as carboxymethyl cellulose and other cellulose ethers, hydroxyethyl and hydroxypropyl cellulose, etc., and
- inorganic compounds, such as polysilicic acids, clay minerals such as montmorillonites, zeolites and silicic acids.

A first group of particularly preferred hydrocolloids is formed by the fully synthetic hydrocolloids, in particular polyacrylic polymers and polymethacrylic polymers, particularly preferably crosslinked polyacrylic acid polymers.

Polyacrylic and polymethacrylic polymers which are advantageous according to the invention should be understood to mean crosslinked or uncrosslinked polyacrylic acid and/or polymethacrylic acid polymers, such as those available from 3V Sigma under the trade names Synthalen K or Synthalen M or from Lubrizol under the trade names Carbopol (for example Carbopol 980, 981, 954, 2984, 5984 and/or Silk 100), each with the INCI name Carbomer. The product marketed by BASF and known by the trade name Cosmedia SP (INCI name: Sodium Polyacrylate) can also be mentioned in this context as a preferred acrylic acid homopolymer.

Copolymers of acrylic acid and/or methacrylic acid can also be used as suitable polyacrylic and polymethacrylic polymers. A suitable polymer in this context is the polymer known by the INCI name Acrylates/C10-30 Alkyl Acrylate Crosspolymer, which is available from Noveon under the trade name Carbopol 1382. A further suitable polymer is the polymer known by the INCI name Acrylates/Steareth-20 Methacrylate Crosspolymer, which is marketed, for example, by Rohm & Haas under the trade name Aculyn® 88. Polymers of the INCI nomenclature Acrylates/Palmeth-25 Acrylate Copolymer or Acrylates/Palmeth-20 Acrylate Copolymer can also be used. Such polymers are available, for example, from 3V Sigma under the trade name Synthalen® W 2000.

It may also be preferable to use a copolymer of at least one anionic acrylic acid or methacrylic acid monomer and at least one non-ionogenic monomer.

Preferred non-ionogenic monomers in this context are acrylamide, methacrylamide, acrylic acid esters, methacrylic acid esters, vinylpyrrolidone, vinyl ethers and vinyl esters.

Further preferred polyacrylic and polymethacrylic polymers are, for example, copolymers of acrylic acid and/or methacrylic acid and the $C_1$-$C_6$ alkyl esters thereof, such as those marketed under the INCI name Acrylates Copolymer. One preferred commercial product is Aculyn® 33 from Rohm & Haas, for example. However, copolymers of acrylic acid and/or methacrylic acid, the $C_1$-$C_6$ alkyl esters of acrylic acid and/or methacrylic acid and the esters of an ethylenically unsaturated acid and an alkoxylated fatty alcohol are also preferred. Suitable ethylenically unsaturated acids are in particular acrylic acid, methacrylic acid and itaconic acid, and suitable alkoxylated fatty alcohols are in particular Steareth-20 or Ceteth-20. Such copolymers are marketed by Rohm & Haas under the trade name Aculyn® 22 (INCI Name: Acrylates/Steareth-20 Methacrylate Copolymer).

A second group of particularly preferred hydrocolloids is formed by natural hydrocolloids, preferably hydrocolloids from the group of gelatin, agar, gum arabic, guar gum, gellan gum, alginates, carrageenan carraghenates and pectins, particularly preferably from the group of gelatin and agar. The proportion by weight of the natural hydrocolloid with respect to the total weight of the dimensionally stable, fragrance-containing shaped body is preferably 0.2 to 25 wt. %, and in particular 1.0 to 22 wt. %.

Particularly preferred gel shaped bodies are characterized in that the carrier material comprises i) a solvent, and ii) a hydrocolloid, preferably a hydrocolloid from the group of natural hydrocolloids, preferably hydrocolloids from the group of gelatin, agar, gum arabic, guar gum, gellan gum, alginates, carrageenan carraghenates and pectins, particularly preferably from the group of gelatin and agar.

As an alternative to the hydrocolloids described above, gelling agents are suitable which have at least one hydrocarbon structural unit having 6 to 20 carbon atoms (preferably at least one carbocyclic, aromatic structural unit) and additionally an organic structural unit covalently bonded to the aforementioned hydrocarbon unit, which structural unit has at least two groups selected from —OH, —NH—, or mixtures thereof.

Particularly preferred gel shaped bodies comprising at least one benzylidene alditol compound of formula (GB-I)

(GB-I)

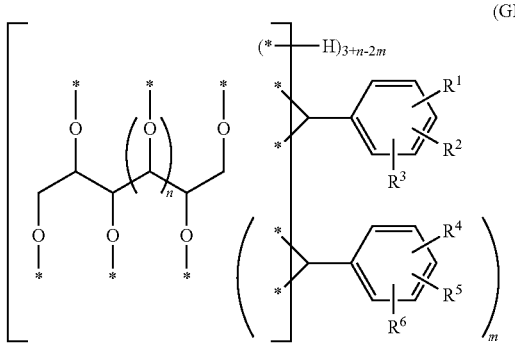

where

*- represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$ alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxyl group, a —C(═O)—NH—$NH_2$ group, a —NH—C(═O)—($C_2$-$C_4$ alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring.

Due to the stereochemistry of the alditols, it should be mentioned that said benzylidene alditols according to the invention are suitable in the L configuration or in the D configuration or in a mixture of the two. Due to natural availability, the benzylidene alditol compounds are preferably used according to the invention in the D configuration. It has proven preferable if the alditol backbone of the benzylidene alditol compound according to formula (GB-I) contained in the shaped body is derived from D-glucitol, D-mannitol, D-arabinitol, D-ribitol, D-xylitol, L-glucitol, L-mannitol, L-arabinitol, L-ribitol or L-xylitol.

Particularly preferred are those gelling agents which are characterized in that $R^1$, $R^2$, $R^3$, $R^4$, $R^5$ and $R^6$ according to the benzylidene alditol compound of formula (GB-I) mean, independently of one another, a hydrogen atom, methyl, ethyl, chlorine, fluorine, or methoxy, preferably a hydrogen atom.

n according to the benzylidene alditol compound of formula (GB-I) preferably represents 1.

m according to the benzylidene alditol compound of formula (GB-I) preferably represents 1.

The shaped bodies very particularly preferably contain at least one compound of formula (GB-I1) as the benzylidene alditol compound of formula (GB-I)

(GB-I1)

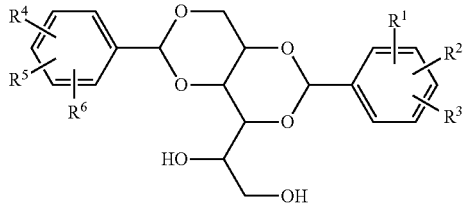

where $R^1$, $R^2$, $R^3$, $R^4$, $R^5$ and $R^6$ are as defined in formula (I). Most preferably, according to formula (GB-I1), $R^1$, $R^2$, $R^3$, $R^4$, $R^5$ and $R^6$ represent, independently of one another, a hydrogen atom, methyl, ethyl, chlorine, fluorine, or methoxy, preferably a hydrogen atom.

Most preferably, the benzylidene alditol compound of formula (GB-I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-Di-O-(3,4-dimethylbenzylidene)-D-sorbitol or mixtures thereof.

Preferred shaped bodies contain at least one 2,5-diketopiperazine compound of formula (GB-II) as the gelling agent (GB-II)

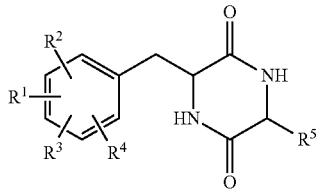

where $R^1$, $R^2$, $R^3$ and $R^4$ represent, independently of one another, a hydrogen atom, a hydroxyl group, a ($C_1$-$C_6$) alkyl group, a ($C_2$-$C_6$) alkenyl group, a ($C_2$-$C_6$)) acyl group, a ($C_2$-$C_6$) acyloxy group, a ($C_1$-$C_6$) alkoxy group, an amino group, a ($C_2$-$C_6$) acylamino group, a ($C_1$-$C_6$) alkylaminocarbonyl group, an aryl group, an aroyl group, an aroyloxy group, an aryloxy group, an aryl-($C_1$-$C_4$) alkyloxy group, an aryl-($C_1$-$C_3$) alkyl group, a heteroaryl group, a heteroaryl-($C_1$-$C_3$) alkyl group, a ($C_1$-$C_4$) hydroxyalkyl group, a ($C_1$-$C_4$) aminoalkyl group, a carboxy-($C_1$-$C_3$) alkyl group, where at least two of the functional groups $R^1$ to $R^4$ can form, together with the remainder of the molecule, a 5-membered or 6-membered ring, and $R^5$ represents a hydrogen atom, a linear ($C_1$ to $C_6$) alkyl group, a branched ($C_3$ to $C_{10}$) alkyl group, a ($C_3$ to $C_6$) cycloalkyl group, a ($C_2$-$C_6$) alkenyl group, a ($C_2$-$C_6$) alkynyl group, a ($C_1$-$C_4$) hydroxyalkyl group, a ($C_1$-$C_4$) alkoxy-($C_1$-$C_4$) alkyl group, a ($C_1$-$C_4$) acyloxy-($C_1$-$C_4$) alkyl group, an aryloxy-($C_1$-$C_4$) alkyl group, an O-(aryl-($C_1$-$C_4$) alkyl)oxy-($C_1$-$C_4$) alkyl group, a ($C_1$-$C_4$) alkylsulfanyl-($C_1$-$C_4$) alkyl group, an aryl group, an aryl-($C_1$-$C_3$) alkyl group, a heteroaryl group, a heteroaryl-($C_1$-$C_3$) alkyl group, a ($C_1$-$C_4$) hydroxyalkyl group, a ($C_1$-$C_4$) aminoalkyl group, an N—($C_1$-$C_4$) alkylamino-($C_1$-$C_4$) alkyl group, an N,N—($C_1$-$C_4$) dialkylamino-($C_1$-$C_4$) alkyl group, an N—($C_2$-$C_8$) acylamino-($C_1$-$C_4$) alkyl group, an N—($C_2$-$C_8$) acyl-N—($C_1$-$C_4$) alkylamino-($C_1$-$C_4$) alkyl group, an N—($C_2$-$C_8$) aroyl-N—($C_1$-$C_4$) alkylamino-($C_1$-$C_4$) alkyl group, an N,N—($C_2$-$C_8$) diacylamino-($C_1$-$C_4$) alkyl group, an N-(aryl-($C_1$-$C_4$) alkyl)amino-($C_1$-$C_4$) alkyl group, an N,N-di(aryl-($C_1$-$C_4$) alkyl)amino-($C_1$-$C_4$) alkyl group, a ($C_1$-$C_4$) carboxyalkyl group, a ($C_1$-$C_4$) alkoxycarbonyl-($C_1$-$C_3$) alkyl group, a ($C_1$-$C_4$) acyloxy-($C_1$-$C_3$) alkyl group, a guanidino-($C_1$-$C_3$) alkyl group, an aminocarbonyl($C_1$-$C_4$) alkyl group, an N—($C_1$-$C_4$) alkylaminocarbonyl-($C_1$-$C_4$) alkyl group, an N,N-di(($C_1$-$C_4$) alkyl)aminocarbonyl-($C_1$-$C_4$) alkyl group, an N—($C_2$-$C_8$) acylaminocarbonyl-($C_1$-$C_4$) alkyl group, an N,N—($C_2$-$C_8$) diacylaminocarbonyl-($C_1$-$C_4$) alkyl group, an N—($C_2$-$C_8$) acyl-N—($C_1$-$C_4$) alkylaminocarbonyl-($C_1$-$C_4$) alkyl group, an N-(aryl-($C_1$-$C_4$) alkyl)aminocarbonyl-($C_1$-$C_4$) alkyl group, an N-(aryl-($C_1$-$C_4$) $C_6$) alkylaminocarbonyl-($C_1$-$C_4$) alkyl group or an N,N-di(aryl-($C_1$-$C_4$) alkyl)aminocarbonyl-($C_1$-$C_4$) alkyl group.

It is preferred according to the invention if $R^3$ and $R^4$ according to formula (GB-II) represent a hydrogen atom. It is particularly preferred according to the invention if $R^2$, $R^3$ and $R^4$ according to formula (GB-II) represent a hydrogen atom. Therefore, particularly preferred shaped bodies according to the invention contain at least one 2,5-diketopiperazine compound according to formula (GB-IIa)

(GB-IIa)

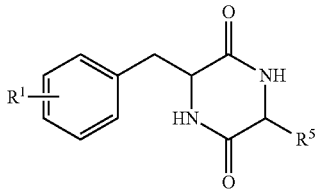

where $R^1$ and $R^5$ are as defined under formula (GB-II) (vide supra).

It has been found to be preferred if the functional group $R^1$ according to formula (GB-II) and according to formula (GB-IIa) binds in the para position of the phenyl ring. Within the meaning of the present invention, such shaped bodies according to the invention are preferred which contain at least one 2,5-diketopiperazine compound according to formula (GB-IIb), (GB-IIb)

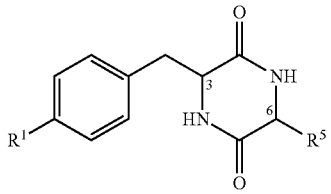

where $R^1$ and $R^5$ are as defined under formula (GB-II) (vide supra). The numbers 3 and 6 positioned on the ring atoms in formula (GB-IIb) only mark positions 3 and 6 of the diketopiperazine ring, as they are generally used in the scope of the invention for naming all 2,5-diketopiperazines according to the invention.

The 2,5-diketopiperazine compounds of formula (GB-II) have centers of chirality at least on the carbon atoms in positions 3 and 6 of the 2,5-diketopiperazine ring. The numbering of ring positions 3 and 6 was illustrated by way of example in formula (GB-IIb). The 2,5-diketopiperazine compound of formula (GB-II) of the composition according to the invention is preferably, based on the stereochemistry of the carbon atoms at the 3 and 6 position of the 2,5-diketopiperazine ring, the configuration isomer 3S,6S, 3R,6S, 3S,6R, 3R,6R, or mixtures thereof, particularly preferably 3S,6S.

Preferred second gel phases contain at least one 2,5-diketopiperazine compound of formula (GB-II) as the gelling agent, selected from 3-benzyl-6-carboxyethyl-2,5-diketopiperazine, 3-benzyl-6-carboxymethyl-2,5-diketopiperazine, 3-benzyl-6-(p-hydroxybenzyl)-2,5-diketopiperazine, 3-benzyl-6-iso-propyl-2,5-diketopiperazine, 3-benzyl-6-(4-aminobutyl)-2,5-diketopiperazine, 3,6-di(benzyl)-2,5-diketopiperazine, 3,6-di(p-hydroxybenzyl)-2,5-diketopiperazine, 3,6-di(p-(benzyloxy)benzyl)-2,5-diketopiperazine, 3-benzyl-6-(4-imidazolyl)methyl-2,5-diketopiperazine, 3-benzyl-6-methyl-2,5-diketopiperazine, 3-benzyl-6-(2-(benzyloxycarbonyl)ethyl)-2,5-diketopiperazine or mixtures thereof. In turn, compounds having the aforementioned configuration isomers are preferably suitable for selection.

It is also possible for the second gel phases to contain at least one diarylamidocystine compound of formula (GB-III) as the gelling agent a)

(GB-III)

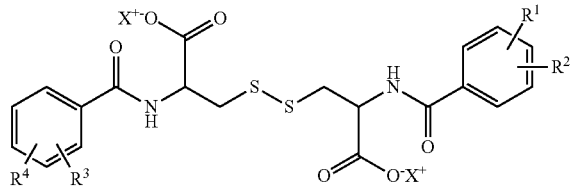

where $X^+$ represents, independently of one another, a hydrogen atom or an equivalent of a cation, $R^1$, $R^2$, $R^3$, and $R^4$ represent, independently of one another, a hydrogen atom, a halogen atom, a $C_1$-$C_4$ alkyl group, a $C_1$-$C_4$ alkoxy group, a $C_2$-$C_4$ hydroxyalkyl group, a hydroxyl group, an amino group, an N—($C_1$-$C_4$ alkyl)amino group, an N,N-di($C_1$-$C_4$ alkyl) amino group, an N—($C_2$-$C_4$ hydroxyalkyl)amino group, an N,N-Di($C_2$-$C_4$ hydroxyalkyl)amino group, or $R^1$ with $R^2$ or $R^3$ with $R^4$ forms a 5-membered or 6-membered annulated ring, which in turn can each be substituted with at least one group from $C_1$-$C_4$ alkyl group, $C_1$-$C_4$ alkoxy group, $C_2$-$C_4$ hydroxyalkyl group, hydroxyl group, amino group, N—($C_1$-$C_4$ alkyl)amino group, N,N-Di($C_1$-$C_4$ alkyl)amino group, N—($C_2$-$C_4$ hydroxyalkyl)amino group, N,N-Di($C_2$-$C_4$ hydroxyalkyl)amino group.

Each of the stereocenters contained in the compound of formula (GB-III) can independently represent the L or D stereoisomer. It is preferable according to the invention for the above-mentioned cystine compound of formula (GB-III) to be derived from the L stereoisomer of the cysteine.

The above-mentioned shaped bodies can contain at least one compound of formula (GB-III), in which $R^1$, $R^2$, $R^3$ and $R^4$ represent, independently of one another, a hydrogen atom, a halogen atom, a $C_1$-$C_4$ alkyl group, a $C_1$-$C_4$ alkoxy group, a $C_2$-$C_4$ hydroxyalkyl group, a hydroxyl group, or $R^1$ with $R^2$ or $R^3$ with $R^4$ forms a 5-membered or 6-membered annulated ring, which in turn can each be substituted with at least one group from $C_1$-$C_4$ alkyl group, $C_1$-$C_4$ alkoxy group, $C_2$-$C_4$ hydroxyalkyl group, or hydroxyl group. In particular, those shaped bodies which contain N,N'-dibenzoylcystine ($R^1$=$R^2$=$R^3$=$R^4$=hydrogen atom; $X^+$=independently of one another, a hydrogen atom or an equivalent of a cation), in particular N,N'-dibenzoyl-L-cystine, as a diarylamidocystine compound of formula (GB-III) are particularly suitable.

The N—($C_8$-$C_{24}$) hydrocarbylglyconamide compounds suitable as the gelling agent preferably have the formula (GB-IV)

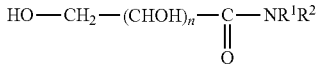

(GB-IV)

where n is 2 to 4, preferably 3 or 4, in particular 4;

$R^1$ is selected from hydrogen, $C_1$-$C_{16}$ alkyl functional groups, $C_1$-$C_3$ hydroxy or methoxyalkyl functional groups, preferably $C_1$-$C_3$ alkyl, hydroxyalkyl, or methoxyalkyl functional groups, particularly preferably methyl;

$R^2$ is selected from $C_8$-$C_{24}$ alkyl functional groups, $C_8$-$C_{24}$ monoalkenyl functional groups, $C_8$-$C_{24}$ dialkenyl functional groups, $C_8$-$C_{24}$ trialkenyl functional groups, $C_8$-$C_{24}$ hydroxyalkyl functional groups, $C_8$-$C_{24}$ hydroxyalkenyl functional groups, $C_1$-$C_3$ hydroxyalkyl functional groups or methoxy-$C_1$-$C_3$ alkyl functional groups, preferably $C_8$-$C_{18}$ alkyl functional groups and mixtures thereof, more preferably $C_8$, $C_{10}$, $C_{12}$, $C_{14}$, $C_{18}$, and $C_{18}$ alkyl functional groups and mixtures thereof, most preferably $C_{12}$ and $C_{14}$ alkyl functional groups or a mixture thereof.

In particularly preferred embodiments, the functional

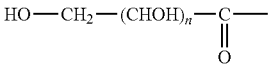

group is a functional group derived from a glycuronic acid, in particular the glycuronic acid of a hexose (n=4). In particular, glucuronic acid should be mentioned as a preferred functional group. $R^1$ is preferably H or a short-chain alkyl functional group, in particular methyl. $R^2$ is preferably a long-chain alkyl functional group, for example a $C_8$-$C_{18}$ alkyl functional group.

Compounds of formula (GB-IV1) are therefore very particularly preferred

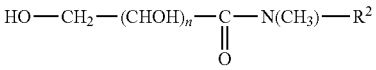

(GB-IV1)

where $R^2$ has the meanings given for formula (GB-IV).

In a particularly preferred embodiment, the gelling agent is selected from the group consisting of benzylidene alditol compound, hydroxystearic acid, hydrogenated castor oil, diarylamidocystine compound, N—($C_8$-$C_{24}$) hydrocarbylglyconamide, diketopiperazine compound, 2-methyl-2-acrylic acid ureido ethyl ester and mixtures thereof. Due to its technical effect, the at least one gelling agent N,N'-dibenzoylcystine (DBC) or dibenzylidene sorbitol (DBS), but in particular dibenzylidene sorbitol (DBS), is particularly preferred.

A second group of particularly preferred gel shaped bodies is characterized in that the carrier material comprises i) a solvent, and ii) a low-molecular-weight gelling agent having a molar mass up to 2,000 g/mol, preferably a low-molecular-weight gelling agent from the group of benzylidene alditol compounds, hydroxystearic acid, hydrogenated castor oil, diarylamidocystine compound, N—($C_8$-$C_{24}$) hydrocarbylglyconamide, diketopiperazine compound, 2-methyl-2-acrylic acid ureido ethyl ester, very particularly preferably a low-molecular-weight gelling agent from the group of dibenzoylcysteine and dibenzylidene sorbitol.

The polymers from the group of celluloses and cellulose derivatives, in particular methyl cellulose, hydroxypropylmethyl cellulose and hydroxypropyl cellulose;

starch, in particular potato starch, corn starch, wheat starch, pea starch or tapioca starch;

polyacrylates;

polyvinyl pyrrolidones; and polyvinyl alcohols have proven to be further advantageous alternatives to the gelling agent discussed thus far. The use of polyvinyl alcohols is particularly advantageous.

Suitable polyacrylates are homopolymers and copolymers of acrylic acid, in particular acrylic acid copolymers such as acrylic acid-methacrylic acid copolymers, and polysaccharides, in particular heteropolysaccharides, and other customary polymer thickeners.

Suitable acrylic acid polymers are, for example, high-molecular-weight homopolymers of acrylic acid (INCI: Carbomer) crosslinked with a polyalkenyl polyether, in particular an allyl ether of sucrose, pentaerythritol or propylene, and also referred to as carboxyvinyl polymers. Polyacrylic acids of this kind are available, inter alia, from BFGoodrich under the trade name Carbopof®.

However, particularly suitable polymers are the following acrylic acid copolymers: (i) copolymers of two or more monomers from the group of acrylic acid, methacrylic acid and their simple esters, preferably formed with $C_{1-4}$ alkanols (INCI: Acrylates Copolymer), which include, for example, the copolymers of methacrylic acid, butyl acrylate and methyl methacrylate (CAS 25035-69-2) or butyl acrylate and methyl methacrylate (CAS 25852-37-3) and which are available, for example, from Rohm & Haas under the trade names Aculyn® and Acusol® and from Degussa (Goldschmidt) under the trade name Tego® Polymer; and (ii) crosslinked high-molecular-weight acrylic acid copolymers, which include, for example, the copolymers of $C_{10}$-30 alkyl acrylates crosslinked with an allyl ether of sucrose or pentaerythritol with one or more monomers from the group of acrylic acid, methacrylic acid and their simple esters, preferably formed with $C_{14}$ alkanols (INCI: Acrylates/$C_{10}$-30 Alkyl Acrylate Crosspolymer) and which are available, for example, from BFGoodrich under the trade name Carbopol®. Suitable acrylic acid esters are also available from BASF under the trade names Skalan® AT 120 and Rheovis® AT 120. If acrylic acid polymers, and in particular acrylic acid esters, are used as polymer thickeners, the pH is preferably more than 7, in particular at least 7.5, preferably 8 or more.

Preferred polyvinyl alcohols have a molecular weight of 10,000 g/mol to 150,000 g/mol, particularly preferably of 10,000 g/mol to 80,000 g/mol and in particular of 10,000 g/mol to 40,000 g/mol. The degree of hydrolysis of preferred polyvinyl alcohols is 70 to 100 mol. %, preferably 80 to 90 mol. %, particularly preferably 81 to 89 mol. %, and in particular 82 to 88 mol. %.

A third group of particularly preferred gel shaped bodies is characterized in that the carrier material comprises i) a solvent, and ii) a polymeric gelling agent having a molar mass of 10,000 g/mol to 200,000 g/mol, preferably a polymeric gelling agent from the group of
   - celluloses and cellulose derivatives, in particular methyl cellulose, hydroxypropylmethyl cellulose and hydroxypropyl cellulose;
   - starch, in particular potato starch, corn starch, wheat starch, pea starch or tapioca starch;
   - polyacrylates;
   - polyvinyl pyrrolidones; and
   - polyvinyl alcohols very particularly preferably from the group of polyvinyl alcohols.

The shaped bodies comprise fragrance as a second essential constituent. A fragrance is a chemical substance that stimulates the sense of smell. In order to be able to stimulate the sense of smell, it should be possible to at least partially distribute the chemical substance in the air, i.e., the fragrance should be volatile at 25° C. at least to a small extent. If the fragrance is very volatile, the odor intensity abates quickly. At a lower volatility, however, the smell is longer-lasting, i.e., it does not disappear as quickly. In one embodiment, the fragrance therefore has a melting point in the range of −100° C. to 100° C., preferably of −80° C. to 80° C., more preferably of −20° C. to 50° C., in particular of −30° C. to 20° C. In another embodiment, the fragrance has a boiling point in the range of 25° C. to 400° C., preferably of 50° C. to 380° C., more preferably of 75° C. to 350° C., in particular of 100° C. to 330° C.

Overall, in order to act as a fragrance, a chemical substance should not exceed a certain molecular mass since, if the molecular mass is too high, the required volatility can no longer be ensured. In one embodiment, the fragrance has a molecular mass of 40 to 700 g/mol, more preferably of 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to overlay unpleasant odors or even to provide a non-smelling substance with a desired odor. It is possible, for example, to use individual odorant compounds, such as synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymene (3-(4-isopropylphenyl)-2-methylpropanal), ethylvanillin, Florhydral (3-(3-isopropylphenyl)butanal), Helional (3-(3,4-methylenedioxyphenyl)-2-methylpropanal), heliotropin, hydroxycitronellal, lauraldehyde, Lyral (3- and 4-(4-hydroxy-4-methylpentyl)-3-cyclohexene-1-carboxaldehyde), methylnonylacetaldehyde, Lilial (3-(4-tert-butylphenyl)-2-methylpropanal), phenylacetaldehyde, undecylenealdehyde, vanillin, 2,6,10-trimethyl-9-undecenal, 3-dodecen-1-al, alpha-n-amylcinnamaldehyde, melonal (2,6-dimethyl-5-heptenal), 2,4-di-methyl-3-cyclohexene-1-carboxaldehyde (Triplal), 4-methoxybenzaldehyde, benzaldehyde, 3-(4-tert-butylphenyl)-propanal, 2-methyl-3-(para-methoxyphenyl) propanal, 2-methyl-4-(2,6,6-timethyl-2(1)-cyclohexen-1-yl) butanal, 3-phenyl-2-propenal, cis-/trans-3,7-dimethyl-2,6-octadien-1-al, 3,7-dimethyl-6-octen-1-al, [(3,7-dimethyl-6-octenyl)oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha, alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methyl-undecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanoindan-1- or 2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyl-octanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexene-carboxaldehyde, 3J-dimethyl-2-methylene-6-octenal, phenoxyacetaldehyde, 5,9-dimethyl-4,8-decadienal, peonyaldehyde (6,10-dimethyl-3-oxa-5,9-undecadien-1-al), hexahydro-4,7-methanindan-1-carboxaldehyde, 2-methyloctanal, alpha-methyl-4-(1-methylethyl)benzeneacetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyldihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, Iso-E-Super (1-(1,2,3,4,5,6J,8-octahydro-2,3,8,8-tetramethyl-2-naphthalenyl)-ethan-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-isopropyldecahydro-2-naphthone, dimethyloctenone, frescomenthe (2-butan-2-yl-cyclohexan-1-one), 4-(1-ethoxyvinyl)-3,3,5,5-tetramethylcyclohexanone, methylheptenone, 2-(2-(4-methyl-3-cyclohexen-1-yl)propyl)cyclopentanone, 1-(p-menthen-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, Dulcinyl (4-(1,3-benzodioxol-5-yl)butan-2-one), Hexalone (1-(2,6,6-trimethyl-2-cyclohexen-1-yl)-1,6-heptadien-3-one), Isocyclemone E (2-acetonaphthone-1,2,3,4,5,6,7,8-octahydro-2,3,8,8-tetramethyl), methyl nonylketone, methylcyclocitrone, methyl lavender ketone, Orivone (4-tert-amylcyclohexanone), 4-tert-butylcyclohexanone, Delphone (2-pentyl-cyclopentanone), muscone (CAS 541-91-3), Neobutenone (1-(5,5-dimethyl-1-cyclohexenyl)pent-4-en-1-one), plicatone (CAS 41724-19-0), Veloutone (2,2,5-trimethyl-5-pentylcyclopentan-1-one), 2,4,4,7-tetramethyl-oct-6-en-3-one and tetramerane (6,10-dimethylundecen-2-one).

Fragrance compounds of the alcohol type are, for example, 10-undecen-1-ol, 2,6-dimethylheptan-2-ol, 2-methylbutanol, 2-methylpentanol, 2-phenoxyethanol, 2-phenylpropanol, 2-tert-butycyclohexanol, 3,5,5-trimethylcyclohexanol, 3-hexanol, 3-methyl-5-phenylpentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethyl benzyl carbinol, dimethyl heptanol, dimethyloctanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate, and jasmacyclate.

Ethers include, for example, benzyl ethyl ether and Ambroxan. Hydrocarbons mainly include terpenes such as limonene and pinene.

Preferably, mixtures of different fragrances are used, which together produce an appealing fragrance note. Such a mixture of fragrances may also be referred to as perfume or perfume oil. Perfume oils of this kind may also contain natural fragrance mixtures, such as those obtainable from plant sources.

Fragrances of plant origin include essential oils, such as angelica root oil, aniseed oil, arnica blossom oil, basil oil, bay oil, champaca blossom oil, citrus oil, abies alba oil, abies alba cone oil, elemi oil, eucalyptus oil, fennel oil, spruce needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, muscatel oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, sandelice, skatole, terpineol, thyme, thymol, troenan, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

For the prolongation of the active substance effect, in particular of the prolonged fragrance effect, it has proven to be advantageous to encapsulate the fragrance. Core-shell particles are therefore used with particular preference as active ingredient particles. Corresponding particles known to a person skilled in the art have an active-substance-containing core and a shell material surrounding this core. Preferred shell materials for the active ingredient particles are materials from the group consisting of polyurethane, polylactic acid, polyurea, polyamide and melamine-formaldehyde resin.

In a corresponding embodiment, at least some of the fragrance is used in encapsulated form (fragrance capsules), in particular in microcapsules. However, it is also possible to use the entire fragrance in encapsulated form. The microcapsules may be water-soluble and/or water-insoluble microcapsules. For example, melamine-urea-formaldehyde microcapsules, melamine-formaldehyde microcapsules, urea-formaldehyde microcapsules or starch microcapsules can be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

For the subsequent action of the shaped bodies, it has proven to be advantageous if the fragrance is selected from the group of perfume oils and fragrance capsules. The use of a combination of perfume oil and fragrance capsules is very particularly preferred.

The proportion by weight of the fragrance with respect to the total weight of the shaped bodies is preferably 1 to 20 wt. %, particularly preferably 1 to 15 wt. % and in particular 3 to 12 wt. %.

The features of some preferred shaped bodies can be found in the following tables (amounts for the carrier material and the active substances given in wt. % based on the total weight of the agent, unless otherwise indicated).

| | Body 1 | Body 2 | Body 3 | Body 4 | Body 5 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Carrier material | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 6 | Body 7 | Body 8 | Body 9 | Body 10 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Carrier material | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 11 | Body 12 | Body 13 | Body 14 | Body 15 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 16 | Body 17 | Body 18 | Body 19 | Body 20 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 21 | Body 22 | Body 23 | Body 24 | Body 25 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 26 | Body 27 | Body 28 | Body 29 | Body 30 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 31 | Body 32 | Body 33 | Body 34 | Body 35 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 36 | Body 37 | Body 38 | Body 39 | Body 40 |
|---|---|---|---|---|---|
| Mass | 3 to 25 | 3 to 25 | 4 to 22 | 4 to 22 | 5 to 20 |
| Ratio ($cm^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

-continued

| | Body 41 | Body 42 | Body 43 | Body 44 | Body 45 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Carrier material | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 46 | Body 47 | Body 48 | Body 49 | Body 50 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Carrier material | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 51 | Body 52 | Body 53 | Body 54 | Body 55 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 56 | Body 57 | Body 58 | Body 59 | Body 60 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 61 | Body 62 | Body 63 | Body 64 | Body 65 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 66 | Body 67 | Body 68 | Body 69 | Body 70 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 71 | Body 72 | Body 73 | Body 74 | Body 75 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 76 | Body 77 | Body 78 | Body 79 | Body 80 |
|---|---|---|---|---|---|
| Mass | 3 to 25 | 3 to 25 | 4 to 22 | 4 to 22 | 5 to 20 |
| Density ($g/cm^{-3}$) | 1.05 to 1.5 | 1.1 to 1.5 | 1.1 to 1.5 | 1.1 to 1.2 | 1.1 to 1.2 |
| Ratio ($cm^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

| | Body 81 | Body 82 | Body 83 | Body 84 | Body 85 |
|---|---|---|---|---|---|
| Mass | 3 to 25 | 3 to 25 | 4 to 22 | 4 to 22 | 5 to 20 |
| Density ($g/cm^{-3}$) | 0.5 to 0.95 | 0.6 to 0.95 | 0.6 to 0.95 | 0.65 to 0.9 | 0.7 to 0.9 |
| Ratio ($cm^{-1}$)* | 2 to 10 | 2.5 to 8 | 2.5 to 8 | 3 to 7 | 3 to 7 |
| Carrier material | 20 to 95 | 20 to 95 | 40 to 90 | 45 to 90 | 45 to 90 |
| Fragrance | 1 to 20 | 1 to 15 | 1 to 15 | 1 to 15 | 3 to 12 |

| | Body 86 | Body 87 | Body 88 | Body 89 | Body 90 |
|---|---|---|---|---|---|
| Mass | 3 to 25 | 3 to 25 | 4 to 22 | 4 to 22 | 5 to 20 |
| Density ($g/cm^{-3}$) | 0.5 to 0.95 | 0.6 to 0.95 | 0.6 to 0.95 | 0.65 to 0.9 | 0.7 to 0.9 |
| Ratio ($cm^{-1}$)* | 2 to 10 | 2.5 to 8 | 2.5 to 8 | 3 to 7 | 3 to 7 |

-continued

| | | | | | |
|---|---|---|---|---|---|
| Carrier material | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |
| | Body 91 | Body 92 | Body 93 | Body 94 | Body 95 |
| Mass | 3 to 25 | 3 to 25 | 4 to 22 | 4 to 22 | 5 to 20 |
| Density (g/cm$^{-1}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Fragrance | 1 to 20 | 1 to 15 | 1 to 15 | 1 to 15 | 3 to 12 |
| | Body 96 | Body 97 | Body 98 | Body 99 | Body 100 |
| Mass | 3 to 25 | 3 to 25 | 4 to 22 | 4 to 22 | 5 to 20 |
| Density (g/cm$^{-3}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Polyethylene glycol | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |
| | Body 101 | Body 102 | Body 103 | Body 104 | Body 105 |
| Mass | 3 to 25 | 3 to 25 | 4 to 22 | 4 to 22 | 5 to 20 |
| Density (g/cm$^{-3}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Fragrance | 1 to 20 | 1 to 15 | 1 to 15 | 1 to 15 | 3 to 12 |
| | Body 106 | Body 107 | Body 108 | Body 109 | Body 110 |
| Mass | 3 to 25 | 3 to 25 | 4 to 22 | 4 to 22 | 5 to 20 |
| Density (g/cm$^{-3}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Sodium acetate trihydrate | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |
| | Body 111 | Body 112 | Body 113 | Body 114 | Body 115 |
| Mass | 3 to 25 | 3 to 25 | 4 to 22 | 4 to 22 | 5 to 20 |
| Density (g/cm$^{-3}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Fragrance | 1 to 20 | 1 to 15 | 1 to 15 | 1 to 15 | 3 to 12 |
| | Body 116 | Body 117 | Body 118 | Body 119 | Body 120 |
| Mass | 3 to 25 | 3 to 25 | 4 to 22 | 4 to 22 | 5 to 20 |
| Density (g/cm$^{-3}$) | 0.5 to 0.95 | 0.6 to 0.95 | 0.6 to 0.95 | 0.65 to 0.9 | 0.7 to 0.9 |
| Ratio (cm$^{-1}$)* | 2 to 10 | 2.5 to 8 | 2.5 to 8 | 3 to 7 | 3 to 7 |
| Gelling agent/solvent | 20 to 95 | 20 to 95 | 40 to 90 | 45 to 90 | 45 to 90 |
| Perfume oil and fragrance capsules | 1 to 20 | 1 to 15 | 1 to 15 | 1 to 15 | 3 to 12 |

*Ratio of body surface area to body volume

In order to improve the appearance of the shaped bodies, said bodies preferably comprise at least one dye. In this case, it is preferred for the shaped bodies to comprise at least one water-soluble dye, particularly preferably a water-soluble polymer dye. Such dyes are known in the prior art and, based on the total weight of the composition, are typically used in concentrations of 0.001 to 0.5 wt. %, preferably 0.01 to 0.3 wt. %.

Preferred dyes, which can be selected by a person skilled in the art without any difficulty at all, should be highly stable in storage, unaffected by the other ingredients of the detergent or cleaning agent, insensitive to light and should not exhibit pronounced substantivity with respect to textile fibers, in order to avoid dyeing said fibers.

The dye is a conventional dye which can be used for various detergents or cleaning agents. The dye is preferably selected from Acid Red 18 (CI 16255), Acid Red 26, Acid Red 27, Acid Red 33, Acid Red 51, Acid Red 87, Acid Red 88, Acid Red 92, Acid Red 95, Acid Red 249 (CI 18134), Acid Red 52 (CI 45100), Acid Violet 126, Acid Violet 48, Acid Violet 54, Acid Yellow 1, Acid Yellow 3 (CI 47005), Acid Yellow 11, Acid Yellow 23 (CI 19140), Acid Yellow 3, Direct Blue 199 (CI 74190), Direct Yellow 28 (CI 19555), Food Blue 2 (CI 42090), Food Blue 5:2 (CI 42051:2), Food Red 7 (01 16255), Food Yellow 13 (CI 47005), Food Yellow 3 (CI 15985), Food Yellow 4 (CI 19140), Reactive Green 12 and Solvent Green 7 (CI 59040).

Particularly preferred dyes are water-soluble acid dyes, for example Food Yellow 13 (Acid Yellow 3, CI 47005), Food Yellow 4 (Acid Yellow 23, CI 19140), Food Red 7 (Acid Red 18, CI 16255), Food Blue 2 (Acid Blue 9, CI 42090), Food Blue 5 (Acid Blue 3, CI 42051), Acid Red 249 (CI 18134), Acid Red 52 (CI 45100), Acid Violet 126, Acid Violet 48, Acid Blue 80(01 61585), Acid Blue 182, Acid Blue 182, Acid Green 25 (CI 61570) and Acid Green 81.

Water-soluble direct dyes, for example Direct Yellow 28 (CI 19555) and Direct Blue 199 (CI 74190), and water-soluble reactive dyes, for example Reactive Green 12, and the dyes Food Yellow 3 (CI 15985) and Acid Yellow 184, are equally preferably used. Aqueous dispersions of the following pigment dyes are equally preferably used: Pigment Black 7 (CI 77266), Pigment Blue 15 (CI 74160), Pigment Blue 15:1 (CI 74160), Pigment Blue 15:3 (CI 74160), Pigment Green 7 (CI 74260), Pigment Orange 5, Pigment Red 112 (CI 12370), Pigment Red 112 (CI 12370), Pigment Red 122 (CI 73915), Pigment Red 179 (CI 71130), Pigment Red 184 (CI 12487), Pigment Red 188 (CI 12467), Pigment Red 4 (CI 12085), Pigment Red 5 (CI 12490), Pigment Red 9, Pigment Violet 23 (CI 51319), Pigment Yellow 1 (CI 28 11680), Pigment Yellow 13 (CI 21100), Pigment Yellow 154, Pigment Yellow 3 (CI 11710), Pigment Yellow 74, Pigment Yellow 83 (CI 21108) and Pigment Yellow 97. In preferred embodiments, the following pigment dyes are used in the form of dispersions: Pigment Yellow 1 (CI 11680), Pigment Yellow 3 (CI 11710), Pigment Red 112 (CI 12370), Pigment Red 5 (CI 12490), Pigment Red 181 (CI 73360), Pigment Violet 23 (CI 51319), Pigment Blue 15:1 (CI 74160), Pigment Green 7 (CI 74260) and Pigment Black 7 (CI 77266).

In equally preferred embodiments, water-soluble polymer dyes are used, for example Liquitint, Liquitint Blue HP, Liquitint Blue MC, Liquitint Blue 65, Liquitint Cyan 15, Liquitint Patent Blue, Liquitint Violet 129, Liquitint Royal Blue, Liquitint Experimental Yellow 8949-43, Liquitint Green HMC, Liquitint Yellow LP, Liquitint Yellow II and mixtures thereof.

The group of more particularly preferred dyes includes Acid Blue 3, Acid Yellow 23, Acid Red 33, Acid Violet 126, Liquitint Yellow LP, Liquitint Cyan 15, Liquitint Blue HP and Liquitint Blue MC.

The addition of bitter substances primarily serves to prevent oral ingestion of the shaped bodies.

Preferred shaped bodies contain at least one bitter substance in an amount of 0.0001 to 0.05 wt. %, based on the total weight of the composition. Amounts of 0.0005 to 0.02 wt. % are particularly preferred. According to the present invention, bitter substances which are soluble in water at 20° C. to at least 5 g/l are particularly preferred. With regard to an undesired interaction with the fragrance components also contained in the composition, in particular a change in the fragrance note perceived by the consumer, the ionogenic bitter substances have been found to be superior to the non-ionogenic bitter substances. Ionogenic bitter substances consisting of organic cation(s) and organic anion(s) are consequently preferred for the composition according to the invention.

In various embodiments, the at least one bitter substance is therefore an ionogenic bitter substance.

Quaternary ammonium compounds which contain an aromatic group both in the cation and in the anion are exceptionally suitable in the context of the present invention. In various embodiments, the at least one bitter substance is therefore a quaternary ammonium compound.

A suitable quaternary ammonium compound is, for example, without limitation, benzyldiethyl((2,6-xylylcarbamoyl)methyl)ammonium benzoate, which is commercially available under the trademarks Bitrex® and Indigestin®, for example. This compound is also known by the name denatonium benzoate. In various embodiments, the at least one bitter substance is benzyldiethyl((2,6-xylylcarbamoyl)methyl) ammonium benzoate (Bitrex®). If Bitrex® is used, proportions by weight of 0.0001 to 0.05 wt. % are preferred. The information is in each case based on the active substance content and the total weight.

As mentioned at the outset, the shaped bodies are particularly suitable for fragrancing textiles. The shaped bodies can be used both as a stand-alone product and in combination with another agent, preferably in combination with a textile detergent. The application therefore also relates to a textile detergent containing one of the shaped bodies described above. The shaped bodies or textile detergents containing shaped bodies are used primarily to fragrance textile fabrics.

The application also relates to the use of the above-described shaped bodies in methods for treating textiles, in the course of which a shaped body or a textile detergent containing these shaped bodies is introduced into the washing liquor of a textile washing machine.

In summary, the present invention provides, inter alia:

1. A shaped body comprising:
   a) carrier material, and
   b) fragrance,
   wherein the shaped body has a mass between 3 and 25 g and the ratio of body surface area to body volume is 2 $cm^{-1}$ to 10 $cm^{-1}$.
2. The shaped body according to point 1, wherein the shaped body has a mass of 4 to 22 g and in particular 5 to 20 g.
3. The shaped body according to one of the preceding points, wherein the shaped body has a ratio of body surface area to body volume of 2.5 $cm^{-1}$ to 8 $cm^{-1}$ and in particular of 3 $cm^{-1}$ to 7 $cm^{-1}$.
4. The shaped body according to one of the preceding points, wherein the shaped body has at least one planar face.
5. The shaped body according to one of the preceding points, wherein the shaped body does not have a cubic three-dimensional shape.
6. The shaped body according to one of the preceding points, wherein the shaped body has at least one convex face.
7. The shaped body according to one of the preceding points, wherein the shaped body does not have a hemispherical or spherical three-dimensional shape.
8. The shaped body according to one of the preceding points, wherein the shaped body has at least one concave face.
9. The shaped body according to one of the preceding points, wherein the shaped body is in the form of a non-convex body.
10. The shaped body according to one of the preceding points, wherein the shaped body has at least one face which comprises convex and concave portions.
11. The shaped body according to one of the preceding points, wherein the shaped body has at least one mirror plane.
12. The shaped body according to one of the preceding points, wherein the shaped body has a spatial extent of more than 12 mm, preferably more than 18 mm, particularly preferably more than 24 mm and in particular more than 30 mm, in at least one spatial direction.
13. The shaped body according to one of the preceding points, wherein the shaped body has a density above 1 $g/cm^{-3}$, preferably in the range between 1.05 and 1.5 $g/cm^{-3}$, particularly preferably in the range between 1.05 and 1.2 $g/cm^{-3}$.
14. The shaped body according to one of the preceding points, wherein the shaped body has a density below 1 $g/cm^{-3}$, preferably in the range between 0.5 and 0.95 $g/cm^{-3}$, particularly preferably in the range between 0.7 and 0.9 $g/cm^{-3}$.
15. The shaped body according to one of the preceding points, wherein the shaped body has two phases.
16. The shaped body according to one of the preceding points, wherein the carrier material is water-soluble.

17. The shaped body according to one of the preceding points, wherein the shaped body contains water-soluble carrier material, based on its total weight, in an amount of 20 to 95 wt. %, preferably of 40 to 90 wt. %, in particular of 45 to 90 wt. %.
18. The shaped body according to one of the preceding points, wherein the shaped body is a melt shaped body.
19. The shaped body according to one of the preceding points, wherein the carrier material is selected from the group of water-soluble polymers, preferably from the group of polyalkylene glycols, in particular from the group of polyethylene glycols.
20. The shaped body according to one of the preceding points, wherein the carrier material is selected from the group of hydrous salts of which the water vapor partial pressure, at a temperature in the range of 40 to 90° C., preferably of 50 to 85° C., more preferably of 55 to 80° C., corresponds to the $H_2O$ partial pressure of the saturated solution of this salt, and is preferably sodium acetate trihydrate ($Na(CH_3COO).3H_2O$).
21. The shaped body according to one of the preceding points, wherein the shaped body comprises sodium acetate trihydrate as the carrier material in an amount of 20 to 95 wt. %, preferably 30 to 95 wt. %, more preferably 40 to 90 wt. % and in particular 45 to 90 wt. %, based on the total weight of the shaped body.
22. The shaped body according to one of the preceding points, wherein the shaped body is a gel shaped body.
23. The shaped body according to one of points 1 to 16 and 22, wherein the carrier material comprises
    i) a solvent, and
    ii) a hydrocolloid, preferably a hydrocolloid from the group of natural hydrocolloids, preferably hydrocolloids from the group of gelatin, agar, gum arabic, guar gum, gellan gum, alginates, carrageenan carraghenates and pectins, particularly preferably from the group of gelatin and agar.
24. The shaped body according to one of points 1 to 16 and 22, wherein the carrier material comprises
    i) a solvent, and
    ii) a low-molecular-weight gelling agent having a molar mass up to 2,000 g/mol, preferably a low-molecular-weight gelling agent from the group of benzylidene alditol compounds, hydroxystearic acid, hydrogenated castor oil, diarylamidocystine compound, N—($C_8$-$C_{24}$) hydrocarbylglyconamide, diketopiperazine compound, 2-methyl-2-acrylic acid ureido ethyl ester, very particularly preferably a low-molecular-weight gelling agent from the group of dibenzoylcysteine and dibenzylidene sorbitol.
25. The shaped body according to one of points 1 to 16 and 22, wherein the carrier material comprises
    i) a solvent, and
    ii) a polymeric gelling agent having a molar mass of 10,000 g/mol to 200,000 g/mol, preferably a polymeric gelling agent from the group of
        celluloses and cellulose derivatives, in particular methyl cellulose, hydroxypropylmethyl cellulose and hydroxypropyl cellulose;
        starch, in particular potato starch, corn starch, wheat starch, pea starch or tapioca starch;
        polyacrylates;
        polyvinyl pyrrolidones; and
        polyvinyl alcohols,
    very particularly preferably from the group of polyvinyl alcohols.
26. The shaped body according to one of the preceding points, wherein the shaped body comprises perfume oil as the fragrance.
27. The shaped body according to one of the preceding points, wherein the shaped body comprises a combination of perfume oil and fragrance capsules as the fragrance.
28. The shaped body according to one of the preceding points, wherein the shaped body comprises the fragrance, based on its total weight, in an amount of 1 to 20 wt. %, preferably 1 to 15 wt. %, more preferably 3 to 12 wt. %.
29. The shaped body according to one of the preceding points, wherein the shaped body comprises a dye.
30. The shaped body according to one of the preceding points, wherein the shaped body comprises a bitter substance.
31. A textile detergent containing a shaped body according to one of the preceding points.
32. The use of a shaped body or a textile detergent according to one of the preceding points as a textile care agent for fragrancing textile fabrics.
33. A method for treating textiles, in the course of which a shaped body or a textile detergent according to one of points 1 to 31 is introduced into the washing liquor of a textile washing machine.

What is claimed:

1. A shaped body comprising:
a) water-soluble carrier material, and
b) fragrance,
wherein the shaped body has a mass between 3 and 25 g, a density above 1 g/cm$^3$, a ratio of body surface area to body volume that is 2 cm$^{-1}$ to 10 cm$^{-1}$, and disintegrates or dissolves in aqueous media.

2. The shaped body according to claim 1, wherein the shaped body has a mass of 4 to 22 g.

3. The shaped body according to claim 2, wherein the shaped body has a mass of 5 to 20 g.

4. The shaped body according to claim 1, wherein the shaped body has a ratio of body surface area to body volume of 2.5 cm$^{-1}$ to 8 cm$^{-1}$.

5. The shaped body according to claim 4, wherein the shaped body has a ratio of body surface area to body volume of 3 cm$^{-1}$ to 7 cm$^{-1}$.

6. The shaped body according to claim 1, wherein the shaped body contains water-soluble carrier material, based on its total weight, in an amount of 20 to 95 wt. %.

7. The shaped body according to claim 6, wherein the shaped body contains water-soluble carrier material, based on its total weight, in an amount of 40 to 90 wt. %.

8. The shaped body according to claim 6, wherein the shaped body contains water-soluble carrier material, based on its total weight, in an amount of 45 to 90 wt. %.

9. The shaped body according to claim 1, wherein the shaped body is a melt shaped body.

10. The shaped body according to claim 1, wherein the shaped body is a gel shaped body.

11. The shaped body according to claim 1, wherein the shaped body comprises, as the fragrance, a combination of perfume oil and fragrance capsules.

12. The shaped body according to claim 1, wherein the shaped body comprises the fragrance, based on its total weight, in an amount of 1 to 20 wt. %.

13. The shaped body according to claim 12, wherein the shaped body comprises the fragrance, based on its total weight, in an amount of 1 to 15 wt. %.

14. The shaped body according to claim 12, wherein the shaped body comprises the fragrance, based on its total weight, in an amount of 3 to 12 wt. %.

15. The shaped body according to claim 1, wherein it is a textile care agent for fragrancing textile fabrics.

16. A method for treating textiles, comprising introducing the shaped body according to claim 1 into a washing liquor of a textile washing machine.

17. The shaped body according to claim 1, wherein the shaped body further comprises at least one bitter substance, based on its total weight, in an amount of amount of 0.0001 to 0.05 wt. %.

18. A textile detergent comprising the shaped body of claim 1.

19. A method for treating textiles, comprising introducing the textile detergent according to claim 18 into a washing liquor of a textile washing machine.

20. A shaped body comprising:

a) water-soluble carrier material, and b) 12 to 20 wt % fragrance based on the total weight of the shaped body, wherein the shaped body has a mass between 3 and 25 g, a density between 0.5 and 0.95 g/cm$^3$, a ratio of body surface area to body volume that is 2 cm$^{-1}$ to 10 cm$^{-1}$, and disintegrates or dissolves in aqueous media.

* * * * *